US007497738B2

(12) United States Patent
Kuo

(10) Patent No.: US 7,497,738 B2
(45) Date of Patent: Mar. 3, 2009

(54) ELECTRICAL CONNECTOR INTERACTING BETWEEN TWO DIFFERENT INTERFACES

(75) Inventor: Peter Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 121 days.

(21) Appl. No.: 11/541,221

(22) Filed: Sep. 29, 2006

(65) Prior Publication Data

US 2007/0082509 A1 Apr. 12, 2007

(30) Foreign Application Priority Data

Sep. 30, 2005 (CN) ..... 2005 2 0076114 U

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/92*** | (2006.01) |
| ***H01R 33/94*** | (2006.01) |
| ***H01R 33/88*** | (2006.01) |
| ***H01R 33/90*** | (2006.01) |

(52) U.S. Cl. ..... 439/638; 439/654; 439/76.1; 439/75

(58) Field of Classification Search ..... 439/638, 439/76.1, 359, 607, 650–655, 75
See application file for complete search history.

(56) References Cited

U.S. PATENT DOCUMENTS

| | | | | |
|---|---|---|---|---|
| 6,089,916 | A * | 7/2000 | Kuo | 439/610 |
| 6,176,743 | B1 | 1/2001 | Kuo | |
| 6,343,957 | B1 | 2/2002 | Kuo | |

* cited by examiner

*Primary Examiner*—Javaid Nasri
(74) *Attorney, Agent, or Firm*—Wei Te Chung

(57) ABSTRACT

An electrical adapter (100) in accordance with the present invention includes a first connector (20), a second connector (30) and an adapting device (10) electrically interconnecting with the first and the second connectors. The adapting device includes a first printed circuit board (120) defining a number of first through holes (121), a second printed circuit board (130) defining a number of second through holes (131) in alignment with the first through holes, a number of conductive pins (110) inserting through the first and the second through holes, and a conductive shell (140) enclosing the first and the second printed circuit boards and attached to at least one of the first and the second printed circuit boards.

6 Claims, 7 Drawing Sheets

ELECTRICAL CONNECTOR INTERACTING BETWEEN TWO DIFFERENT INTERFACES

This application claims priority to Chinese Patent Application No. 200520076114.0, the disclosure of which is incorporated herein by reference.

BACKGROUND OF THE INVENTION

1. Field of the Invention

The present invention generally relates to an electrical adapter, and more particularly to an electrical adapter for joining two electrical connectors having different designs and configurations.

2. Description of Related Art

A computer mainframe and its periphery device, for example, a monitor is usually electrically connected together by a cable connector assembly, wherein the cable connector assembly has two connectors at its two ends with one connector being used to mate with an electrical connector of the monitor and the other being used to mate with an electrical connector of the computer mainframe.

As the computer technology evolves, new type monitors (for example, digital monitors) with advanced functions are developed which are equipped with connectors having a different configuration in comparison with that of the old ones. To connect the computer mainframe with the new type monitor, an adapter is necessary whereby the cable in the present use can be utilized. The adapter includes two connectors in both ends wherein one is configured suitably for mating with the connector in the new type monitor, and the other is so configured that it can mate with the cable connector assembly.

The connectors of the conventional adapter are usually interconnected using a flat cable, a single printed circuit board (PCB), or discrete conducting wires. However, the conductors of the flat cable and the discrete conducting wires for interconnection need to be connected with terminals of the connectors by soldering, respectively, thereby decreasing production efficiency and complicating production procedure. When one of the connectors of the adapter has more than two rows of terminals, to mount such terminals onto a single printed circuit board having only two circuit faces is relatively difficult.

To solve problems described above, U.S. Pat. No. 6,176,743 B1, assigned to the same assignee as the instant invention, is developed. The electrical adapter disclosed in '743 patent utilizes two printed circuit boards with different lengths to interconnect two connectors with different configurations and designs. This design solves the problems above ideally. However, in some circumstances, Electro Magnetic Interference (EMI) suppression is needed in signal transmission, especially in high speed signal transmission. Therefore, an electrical adapter used for low EMI circumstances is desired.

BRIEF SUMMARY OF THE INVENTION

Accordingly, an object of the present invention is to provide an electrical adapter for realizing interconnection between two different connectors and for EMI suppression.

Another object of the present invention is to provide an adapting device with conductive shell to provide EMI suppression in signal transmission.

In order to achieve the above-mentioned object, an electrical adapter in accordance with the present invention comprises a first connector, a second connector and an adapting device interconnecting with the first and the second connectors. The adapting device comprises a first printed circuit board defining a plurality of first through holes, a second printed circuit board defining a plurality of second through holes in alignment with the first through holes, a plurality of conductive pins inserting through the first and the second through holes to form electrical connection between the first and the second printed circuit boards, and a conductive shell enclosing the first and the second printed circuit boards and attached to at least one of the first and the second printed circuit boards.

Other objects, advantages and novel features of the invention will become more apparent from the following detailed description of the present embodiment when taken in conjunction with the accompanying drawings.

DETAILED DESCRIPTION OF THE INVENTION

Figure 1:
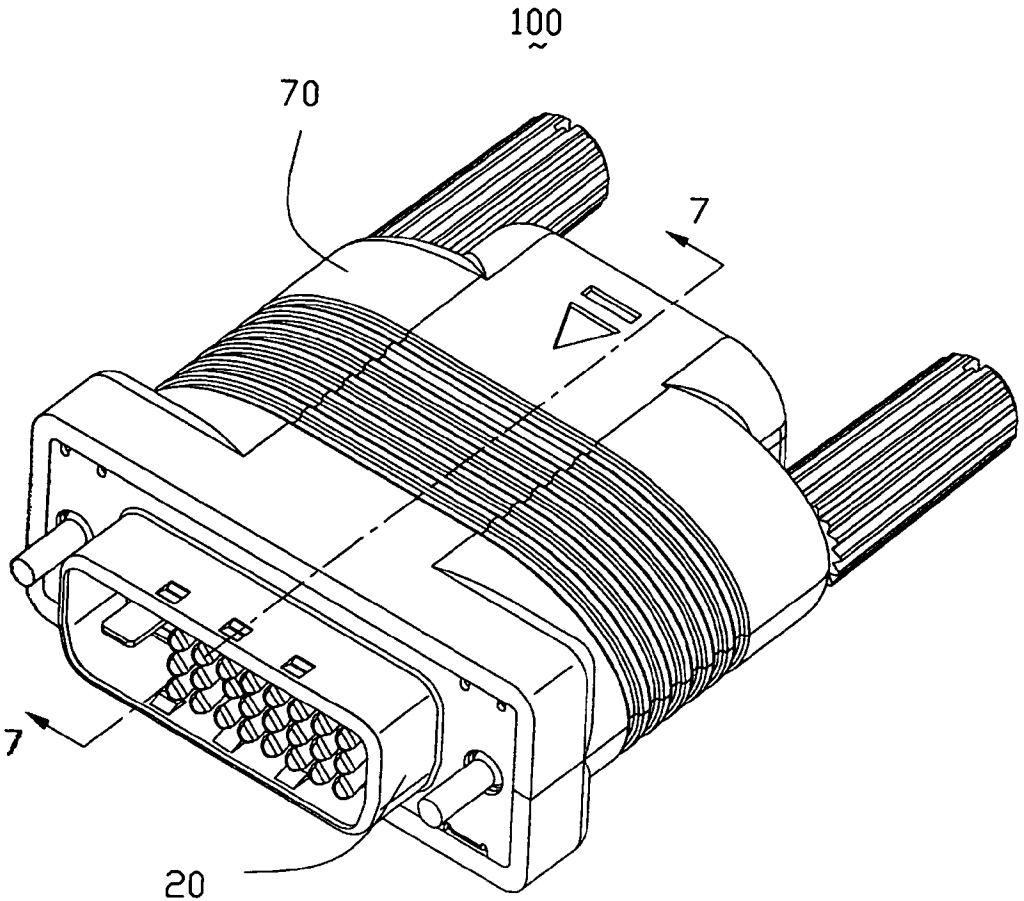
FIG. 1 is an assembled, perspective view of an electrical adapter in accordance with the present invention.
Figure 2:
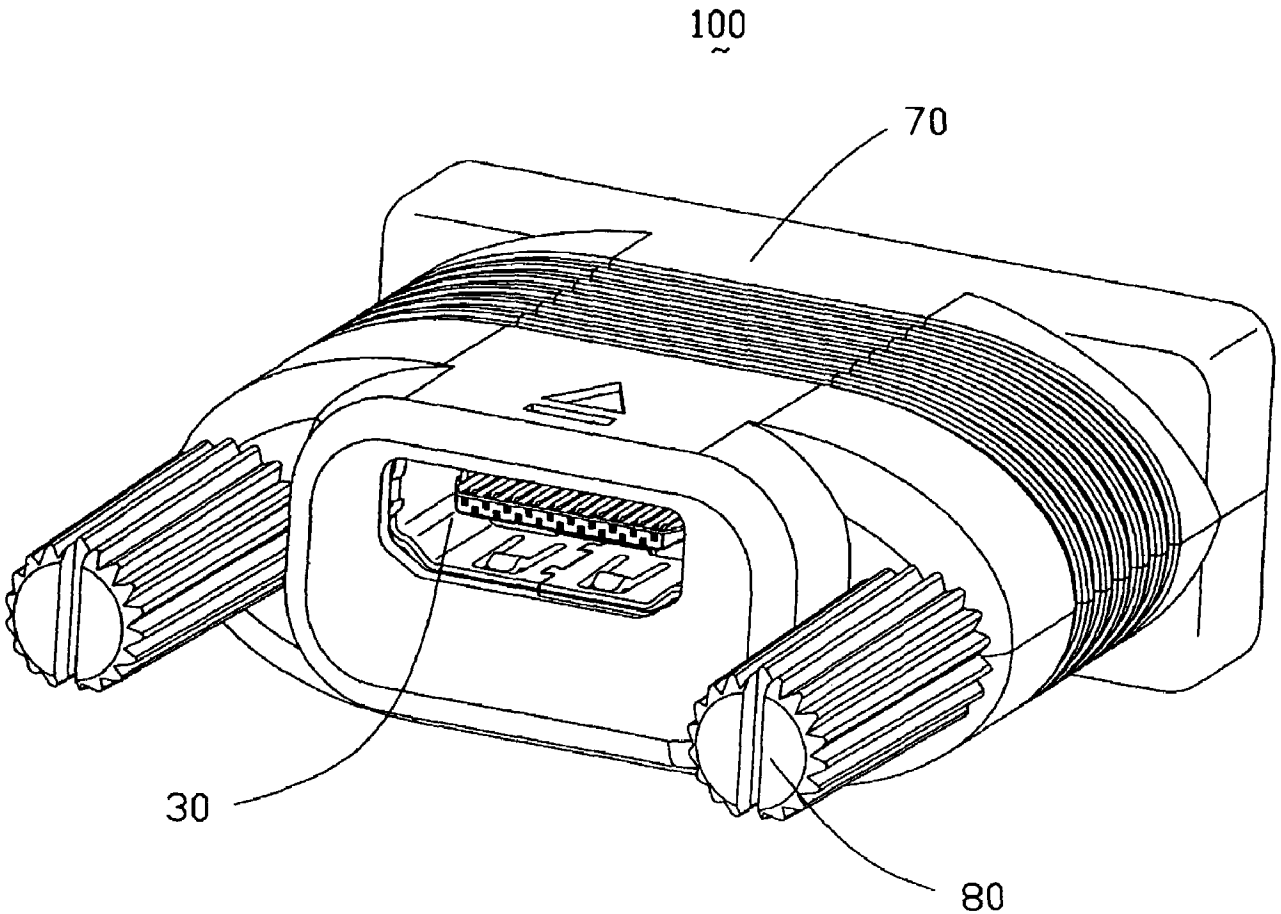
FIG. 2 is a view similar to FIG. 1, but viewed from a different aspect.
Figure 3:
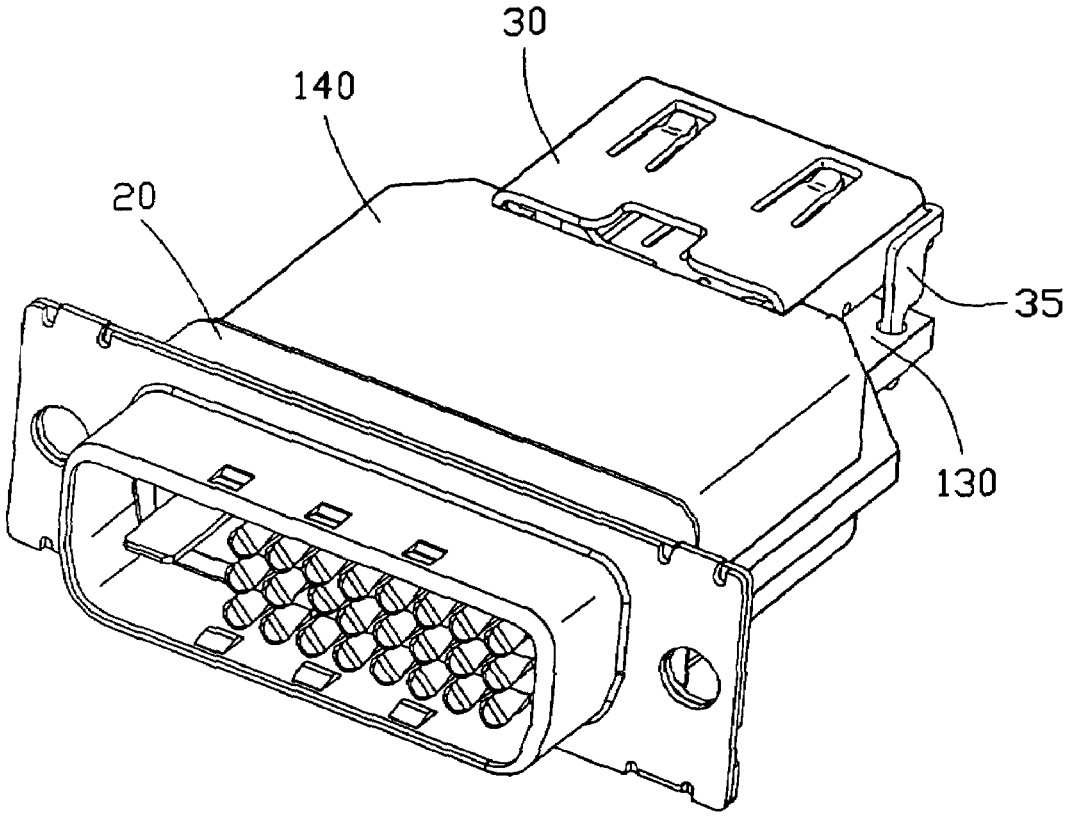
FIG. 3 is a perspective view of the electrical adapter with outer cover removed.
Figure 4:
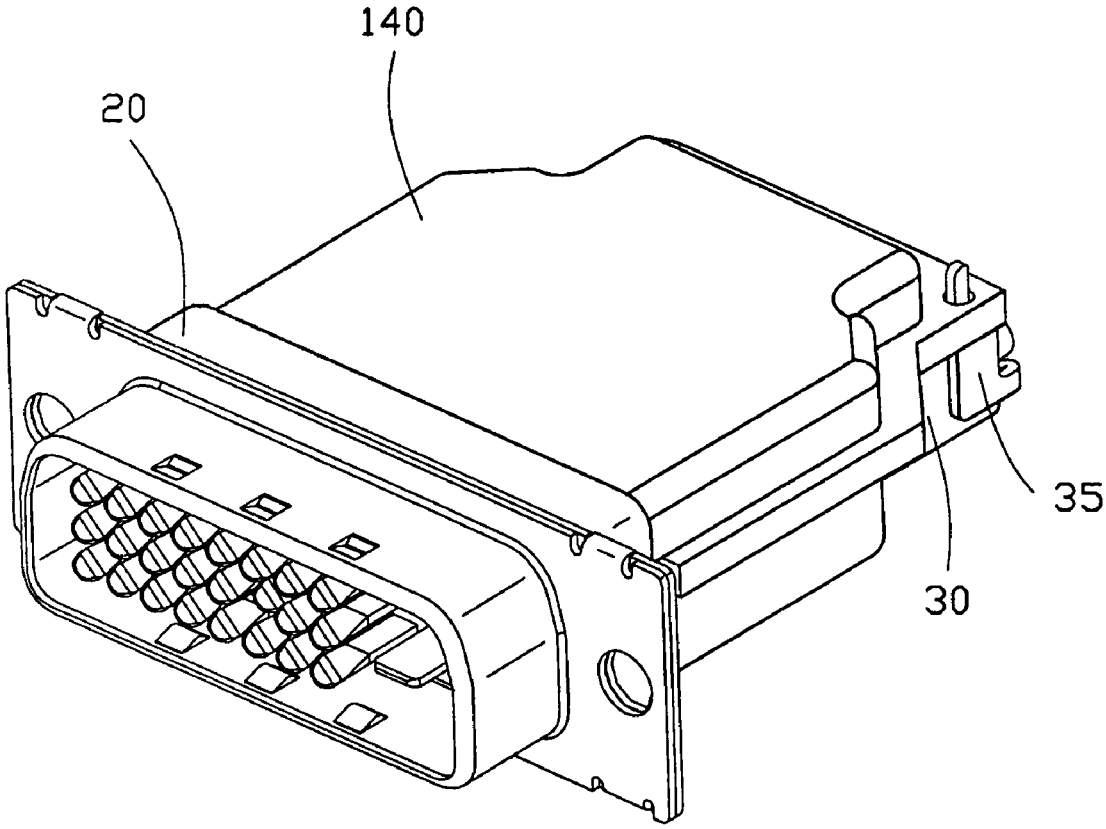
FIG. 4 is a view similar to FIG. 3, but viewed from a different aspect.

Reference will now be made to the drawing figures to describe the present invention in detail.

Please refer to FIGS. 1-7, an electrical adapter 100 in accordance with the present invention for interconnecting two different-type connectors comprises a first connector 20, a second connector 30, an adapting device 10, an outer cover 70 enclosing the first connector 20, the second connector 30, the adapting device 10, and a pair of screws 80 retained in the outer cover 70 for fastening the electrical adapter 100 to an electrical device (not shown).

The adapting device 10 comprises a plurality of conductive pins 110 arranged into two rows, a first printed circuit board 120, a second printed circuit board 130 and a conductive shell 140 shielding the first and second printed circuit boards 120, 130 and electrically connecting with the second printed circuit board 130.

Each of the first and second printed circuit boards 120, 130 has a first surface and an opposite second surface with the second surface of the first printed circuit board 120 facing the first surface of the second printed circuit board 130. The first printed circuit board 120 comprises a front end 123 and an opposite rear end 122. The front end 123 defines a plurality of first through holes 121, while the rear end 122 forms a plurality of golden fingers 101. The second printed circuit board 130 is longer and broader than the first printed circuit board 120. The second printed circuit board 130 comprises a narrowed front end 133, a main body 134, a rear end 135 and an intermediate portion 132 connecting with the front end 133 and the main body 134. The front end 133 of the second printed circuit board 130 defines a pair of spaced arranged openings 1330 and a receiving hole 136 located between the pair of openings 1330. The intermediate portion 132 of the second printed circuit board 130 defines three rows of terminal channels 1300. A plurality of second though holes 131 are defined in the main body 134 corresponding to the first through holes 121 of the first printed circuit board 120. The inner periphery of the first and second though holes 121, 131 are plated with conductive material. For clear illustration, only one row of first through holes 121 and one row of second through holes 131 are shown in figures. A plurality of golden fingers 101 are formed on the rear end 135 of the second printed circuit board 130. The thickness of the first printed circuit board 120 is same as that of the second printed circuit board 130.

The conductive shell 140 comprises an upper half 140*a* and a lower half 140*b* engagable with the upper half 140*a*. Each half 140*a*, 140*b* comprises a plate portion 1400 and a pair of side flanges 1401 downwardly extending from opposite sides of the plate portion 1400.

Figure 5:
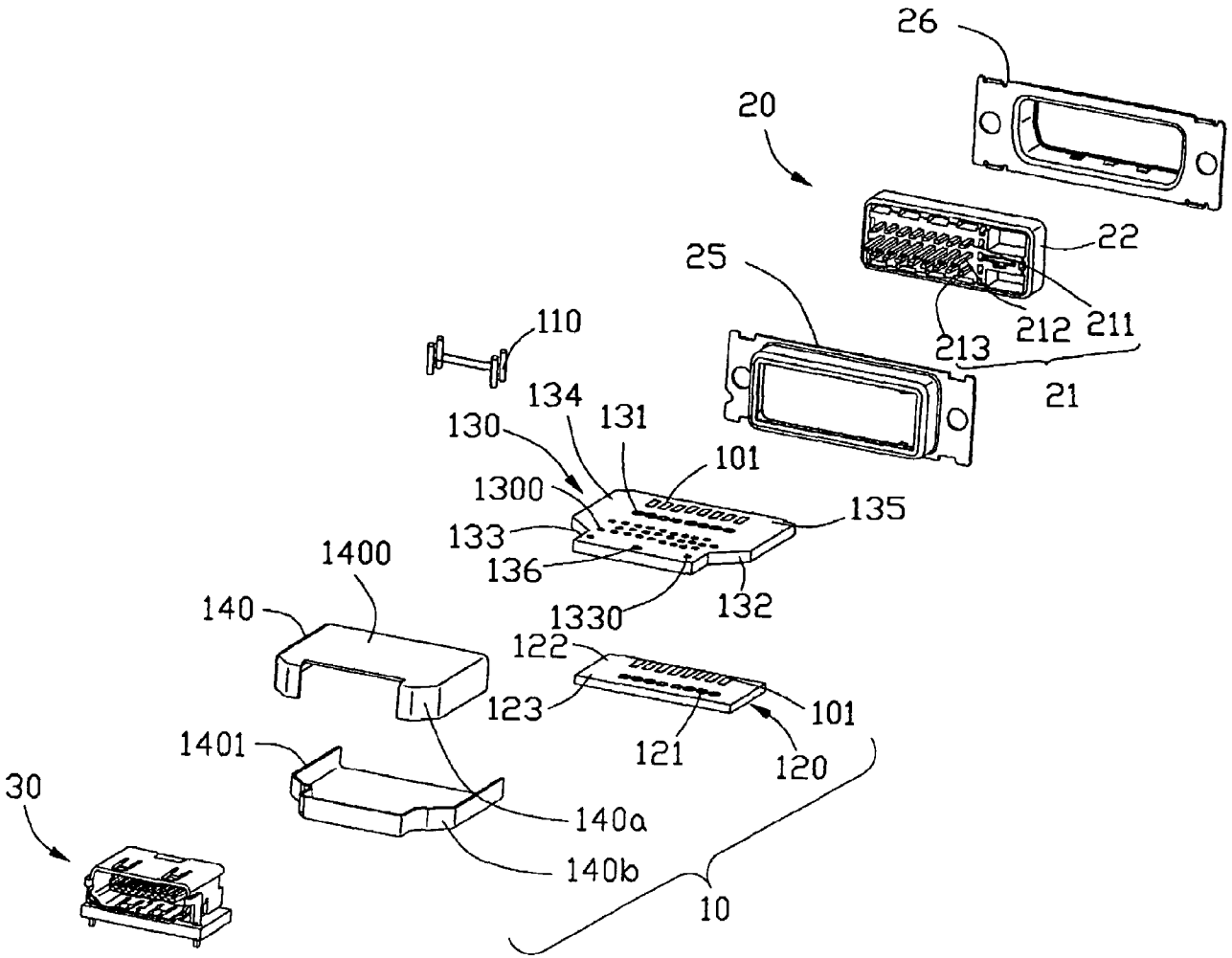
FIG. 5 is an exploded, perspective view of FIG. 3.
Figure 6:
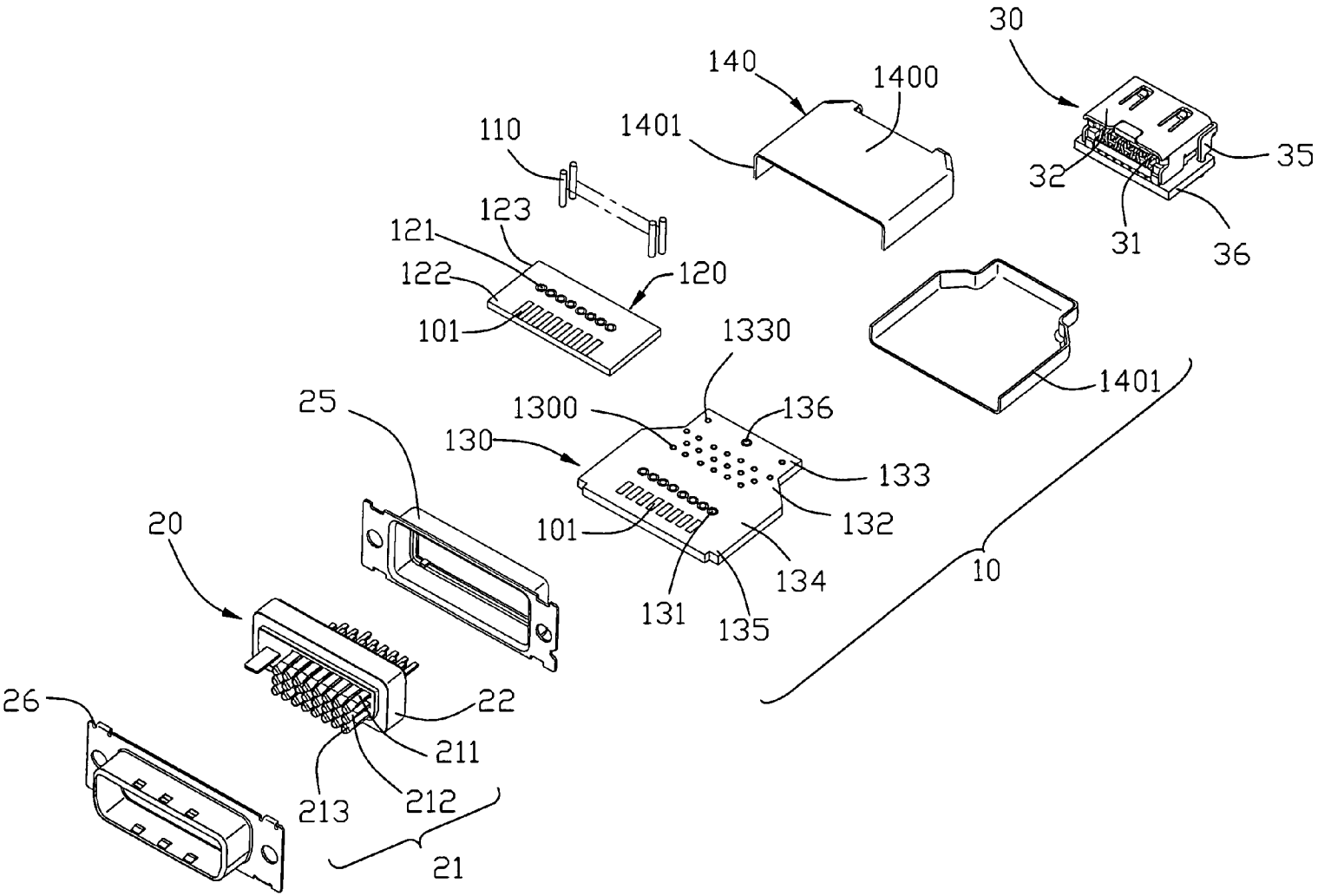
FIG. 6 is a view similar to FIG. 5, but viewed from different aspect.
Figure 7:
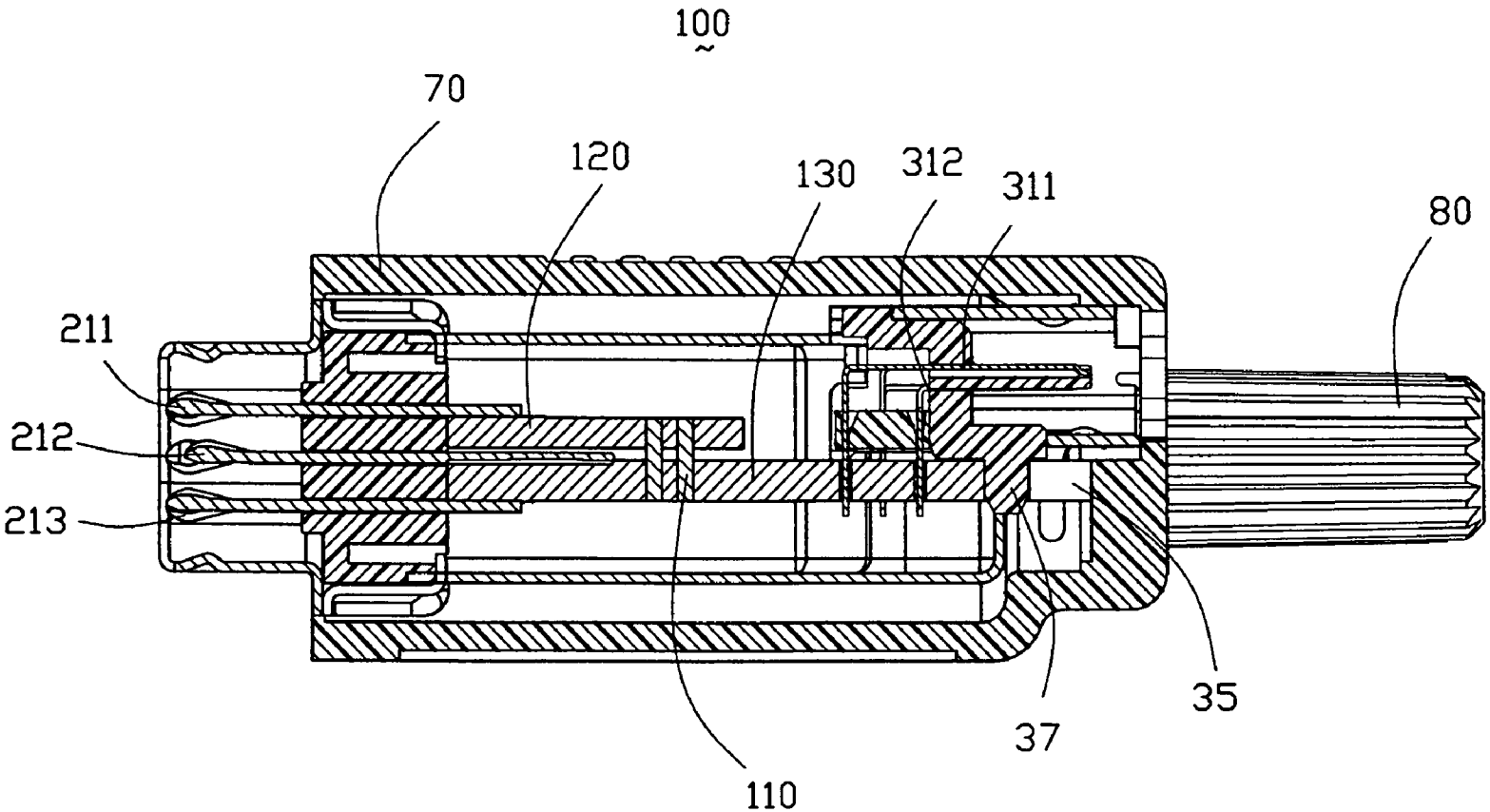
FIG. 7 is a cross-section view taken along lien 7-7 of FIG. 1.

Referring to FIGS. 5-6, the first connector 20 is a connector in accordance with the DVI (Digital Visual Interface) standard in the preferred embodiment. However, the first connector 20 can be any type connector in alternative embodiments without departing from the spirit of the present invention. The first connector 20 comprises an insulative housing 22, a first conductive shield comprising a front shielding case 26, a rear shielding case 25 and a plurality of first terminals 21 accommodated in the insulative housing 22. The first terminals 21 are arranged into an upper row 211, a middle row 212 and a lower row 213.

The second connector 30 is a connector in accordance with the standard of HDMI (High Definition Multimedia Interface) in the preferred embodiment. However, the second connector 30 can be any type connector in alternative embodiments without departing from the spirit of the present invention. The second connector 30 comprises an insulative housing (not labeled), a second conductive shield 32 assembled to the insulative housing and shielding upper and opposite side surfaces of the insulative housing, an enhancing board 36 assembled to the bottom of the insulative housing, and a plurality of second terminals 31. The second conductive shield 32 forms a pair of board locks 35 integrally extending therefrom to pass through the enhancing board 36 and lock with the enhancing board 36. A post 37 (FIG. 7) depends downwardly from the bottom of the insulative housing and interferentially retained in the receiving hole 136 of the second printed circuit board 130 to fix the second connector 30 on the second printed circuit board 130. The second terminals 31 are arranged into a first row 311 and a second row 312 with tail portions bending downwardly. The tail portions of the second row 312 are bent downwardly with different distances from rear surface of the insulative housing. While, the tail portions of the first row 311 are also bent downwardly with different distances from rear surface of the insulative housing. Thus, the tail portions of the two rows 311, 312 are arranged into three rows of through-hole type tail portions.

In assembly, the first through holes 121 of the first printed circuit board 120 are aligned with the second through holes 131 of the second printed circuit board 130. respectively, and the rear ends 122, 135 are also aligned with each other. Two rows of conductive pins 100 are respectively inserted through and interferentially fixed in the aligned first and second through boles 121, 131 and electrically connect with the conductive material plated in the first and second through holes 121, 131, thus, the first printed circuit board 120 electrically connects with the second printed circuit board 130. The first and second printed circuit boards 120, 130 are arranged to be spaced from each other a certain distance which is a little larger than the thickness of the middle row 212 of the first terminals 21. The rear ends. 122, 135 are respectively located between the upper and middle rows 211, 212 and between the middle and lower rows 212, 213 of the first terminals 21. The upper row 211 of the first terminals 21 are soldered with the golden fingers 101 of the rear end 122 of the first printed circuit board 120 to form electrical connection therebetween, while the middle and Lower rows 212, 213, are respectively soldered with the golden fingers 101 formed on first and second surfaces of the rear end 135 of the second printed circuit board 130 to form electrical connection therebetween. The three rows of the tail portions of the second terminals 31 of the second connector 30 respectively protrude through and interferentially retained in the three tows of the terminal channels 1300 of the second printed circuit board 130. Therefore, by such arrangement, the first and second connectors 20, 30 are combined to the two ends of the adapting device 10 to realize the reliable electrical connection therebetween. The upper and lower halves 140*a*, 140*b* of the conductive shell 14 are assembled to each other with side flanges 1401 thereof are respectively soldered to solder pads (not shown) formed on two sides of the second printed circuit board 130 and electrically connect with the second printed circuit board 130. The conductive shell 140 also abuts against the rear shielding case 25 of the first electrical connector 20 and the second conductive shield 32 of the second connector 30 for EMI (Electro Magnetic Interference) suppression and grounding function. Now, referring to FIGS. 1-2, an outer cover 70 made from insulative material is assembled to the assembled first connector 20, the second connector 30 and the adapting device 10. The outer cover 70 can be formed by upper and lower covers to latch with each other and also can be formed by overmold means. in the preferred embodiment, the outer cover 70 forms a pair of screw-receiving channels (not labeled) to receive the Pair of screws 80. Particularly referring to FIGS. 1-2. The outer cover 70 encloses the first connector 20 and the second connector 30, with a mating port or front segment of the first connector 20 exposed out of the outer cover 70; while a mating port or a front portion of the second connector 30 wrapped by the outer cover 70. for its dimensioned much smaller than the outer cover 70 in both thickness and width directions. Furthermore, the mating port of the second connector 30 is offset a middle portion of the outer cover 70 and located around an upper portion of the outer cover 70 (see FIG. 2); while the screws 80 are located around the middle portion of the outer cover 70, and such arrangement facilitates operating the screws 80 when mounting the electrical adapter 100 to corresponding electronic device.

In addition, the conductive pins 110 are manufactured by utilizing the waste material of the terminals or the connectors, which is in favor of recycling material and economizing cost. The use of the two electrically connecting printed circuit boards to realize the electrical connection of two different types of connectors effectively reduces the interference during signal transmission, thus, qualified signal transmission between the two different types of connectors is assured. The conductive shell 140 enhances the EMI suppression.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms which the appended claims are expressed.

What is claimed is:

1. An electrical connector interacting between two different interfaces, comprising:

a first printed circuit board defining a first surface, an opposite second surface and a plurality of first through holes therethrough, the first surface having a contacting region near one end of the first printed circuit board for contacting a first row of terminals of a first type electrical connector;

a second printed circuit board defining a first surface facing the second surface of the first printed circuit board, an opposite second surface and a plurality of second through holes therethrough in alignment with the first through holes of the first printed circuit board, the first and second surfaces each having a contacting region near one end of the second printed circuit board for contacting a second and a third rows of terminals of the first connector;

one of the first and the second printed circuit boards having a pair of contacting regions on the two surfaces near the other end thereof for contacting two rows of terminals of a second connector;

a plurality of conducting pins inserted through and retained in the first and second through holes of the first and second printed circuit boards to form electrical connection between the first and second printed circuit boards; and a conductive shell fully enclosing the first and second printed circuit boards and attached to at least one of the first and second printed circuit boards.

2. The electrical connector as claimed in claim 1, wherein the conductive shell is attached to the second printed circuit board.

3. The electrical connector as claimed in claim 1, wherein the conductive shell comprises an upper half and a lower half engagable with each other to enclose the first and second printed circuit boards therein.

4. The electrical connector as claimed in claim 1, wherein the conducting pins are interferentially fitted into the first and second through holes of the first and second printed circuit boards.

5. The electrical connector as claimed in claim 1, wherein the one ends of the first and the second printed circuit boards contacting the terminals of the first connector register with each other.

6. The electrical connector as claimed in claim 1, wherein the other end of the one of the first printed circuit board and the second printed circuit board extends substantially longer than that of the other printed circuit board and is straddled by the two rows of terminals of the second connector.

* * * * *